US009383721B2

(12) United States Patent
Furuta

(10) Patent No.: US 9,383,721 B2
(45) Date of Patent: Jul. 5, 2016

(54) IMAGE FORMING APPARATUS INCLUDING BLOWER FOR BLOWING AIR AT SHEET

(71) Applicant: KYOCERA Document Solutions Inc., Osaka (JP)

(72) Inventor: Shinji Furuta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/854,264

(22) Filed: Sep. 15, 2015

(65) Prior Publication Data

US 2016/0085210 A1 Mar. 24, 2016

(30) Foreign Application Priority Data

Sep. 18, 2014 (JP) ..... 2014-189826

(51) Int. Cl.

| | |
|---|---|
| ***G03G 15/00*** | (2006.01) |
| ***G03G 21/20*** | (2006.01) |
| ***B65H 5/22*** | (2006.01) |
| ***B65H 9/04*** | (2006.01) |

(52) U.S. Cl.

CPC ..... *G03G 21/206* (2013.01); *B65H 5/228* (2013.01); *B65H 9/04* (2013.01); *G03G 15/6573* (2013.01); *G03G 21/203* (2013.01)

(58) Field of Classification Search

CPC ..... G03G 21/206

USPC ..... 399/92

See application file for complete search history.

(56) References Cited

U.S. PATENT DOCUMENTS

2006/0284960 A1* 12/2006 Kishi ..... G03G 21/206 347/140

FOREIGN PATENT DOCUMENTS

JP H11-015308 A 1/1999

* cited by examiner

*Primary Examiner* — Quana M Grainger

(74) *Attorney, Agent, or Firm* — Studebaker & Brackett PC

(57) ABSTRACT

An image forming apparatus includes an image forming section, a fixing device, a sheet conveyance path, a conveyance guide member, a blower, and a control section. The conveyance guide member constitutes one of a pair of sheet conveyance surface portions of the sheet conveyance path. The blower is disposed on an opposite side of the sheet conveyance surface portion constituted by the conveyance guide member to the sheet conveyance path and blows air at a sheet passing through the sheet conveyance path. A ventilation port and an air passage recess are located in the sheet conveyance surface portion constituted by the conveyance guide member. The ventilation port allows air from the blower to flow into the sheet conveyance path. The air passage recess extends in a sheet width direction. The air passage recess allows air that has passed through the ventilation port to flow through the air passage recess.

15 Claims, 8 Drawing Sheets

IMAGE FORMING APPARATUS INCLUDING BLOWER FOR BLOWING AIR AT SHEET

INCORPORATION BY REFERENCE

The present application claims priority under 35 U.S.C. §119 to Japanese Patent Application No. 2014-189826, filed on Sep. 18, 2014. The contents of this application are incorporated herein by reference in their entirety.

BACKGROUND

The present disclosure relates to an image forming apparatus including a fixing device.

A fixing device included in an electrographic image forming apparatus generally fixes a toner image to paper by melting the toner through application of heat and pressure to the paper.

In a situation in which paper is moist, vapor is generated from the paper heated by the fixing device and condenses in a conveyance path located downstream of the fixing device in a paper conveyance direction. As a result, succeeding paper may become wet due to the condensation and may become wrinkled as a result. In duplex printing, toner may not be transferred to a wet part of the paper re-conveyed to a transfer section, resulting in creation of an image void.

If paper having a high moisture content is heated by the fixing device, vapor may be generated as steam. When the steam is released outside the image forming apparatus, a user may mistake the steam for smoke.

In view of the foregoing, a certain image forming apparatus includes a blower in the vicinity of a paper conveyance path to blow air at paper passing through the paper conveyance path. In the above configuration, steam generated in fixing is dispersed, thereby reducing generation of condensation and steam.

Another image forming apparatus includes a blower and a duct that houses the blower in the vicinity of the paper conveyance path to cool paper and prevent condensation on paper.

SUMMARY

An image forming apparatus according to the present disclosure includes an image forming section, a fixing device, a sheet conveyance path, a conveyance guide member, a blower, and a control section. The image forming section forms a toner image on a sheet. The fixing device is disposed downstream of the image forming section in a sheet conveyance direction and configured to apply heat and pressure to the sheet to fix the as yet unfixed toner image to the sheet. The sheet conveyance path has a pair of sheet conveyance surface portions and guides the sheet to a sheet exit port after the sheet passes through the fixing device. The conveyance guide member constitutes one of the pair of sheet conveyance surface portions. The blower is disposed on an opposite side of the sheet conveyance surface portion constituted by the conveyance guide member to the sheet conveyance path and configured to blow air at the sheet passing through the sheet conveyance path. The control section is configured to control operation of the blower. A ventilation port and an air passage recess are located in the sheet conveyance surface portion constituted by the conveyance guide member. The ventilation port allows air from the blower to flow into the sheet conveyance path. The air passage recess extends in a sheet width direction. The air passage recess allows air that has passed through the ventilation port to flow through the air passage recess. The control section suspends operation of the blower until a sheet is ejected from the sheet exit port after power-up or return from an energy saving mode of the image forming apparatus. The sheet is printed first after the power-up or the return from the energy saving mode of the image forming apparatus.

DETAILED DESCRIPTION

Figure 1:
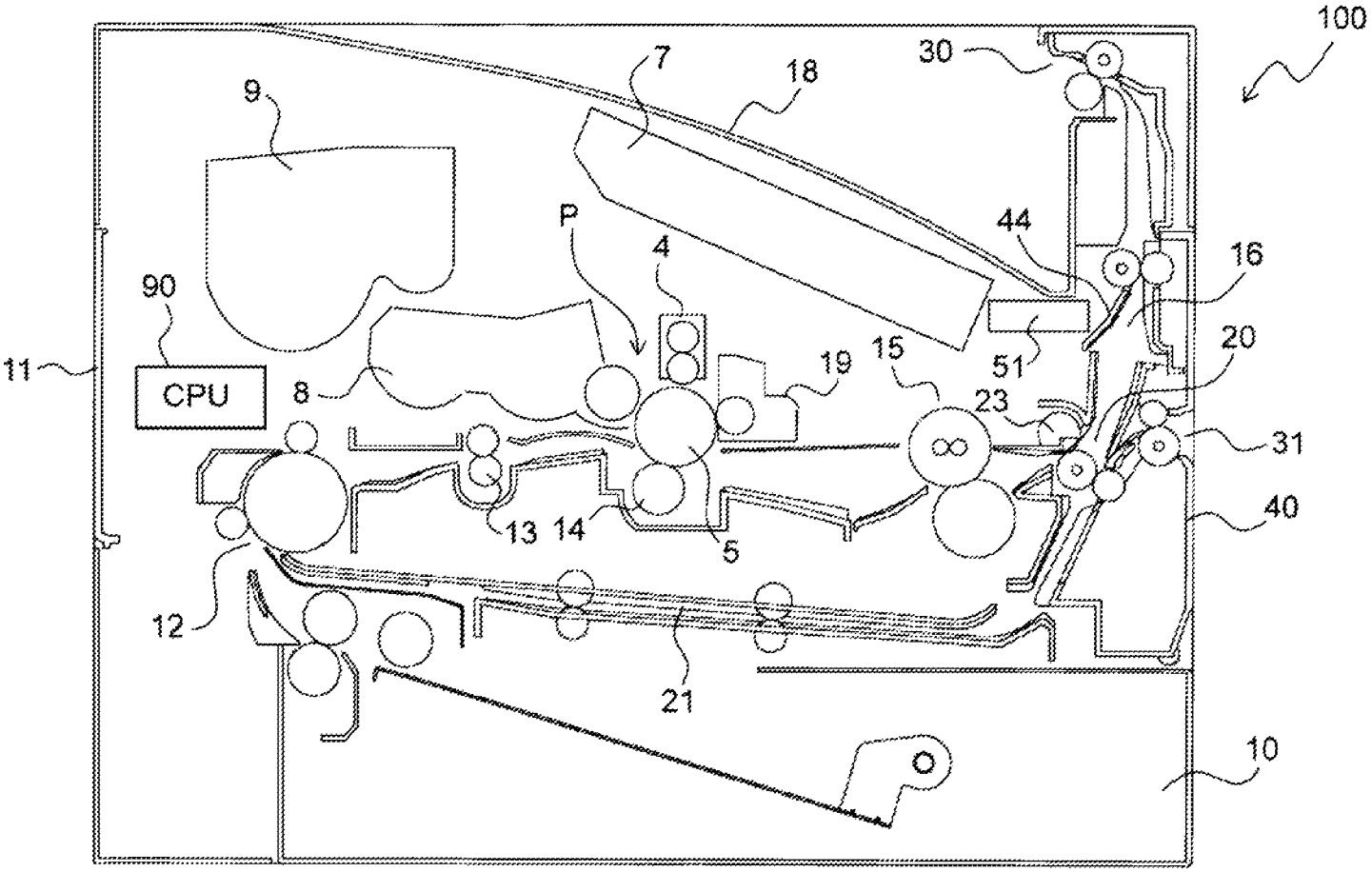
FIG. 1 is a side cross sectional view illustrating an internal configuration of an image forming apparatus according to an embodiment of the present disclosure.
Figure 2:
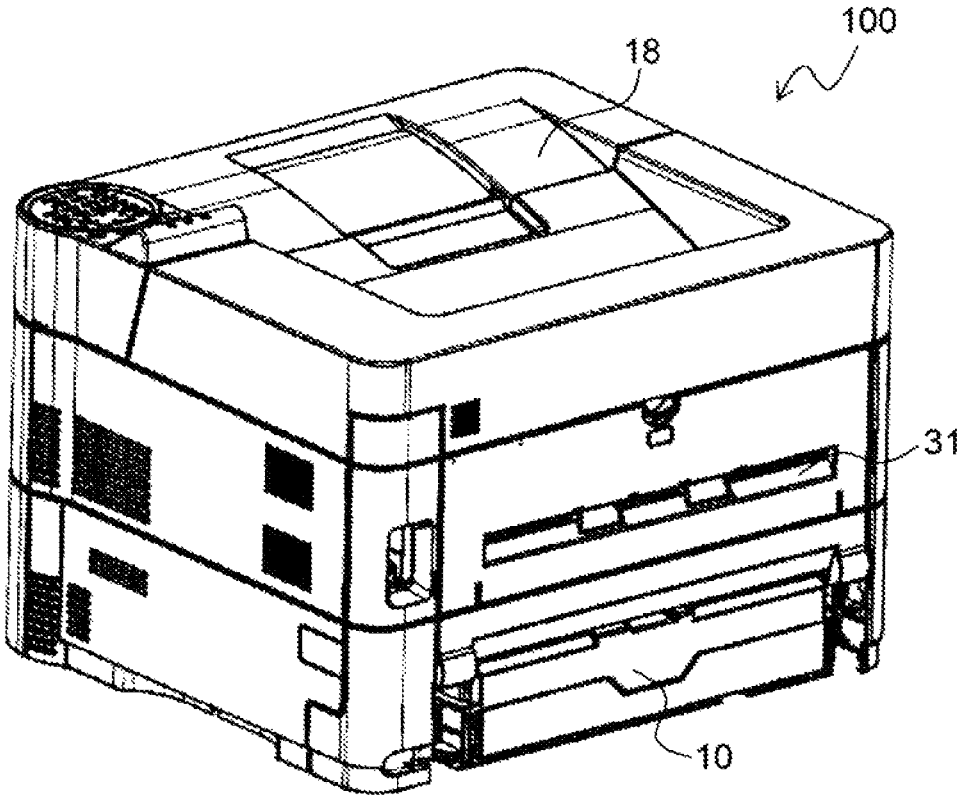
FIG. 2 is an outer perspective view of the image forming apparatus as viewed from the back according to an embodiment of the present disclosure.
Figure 3:
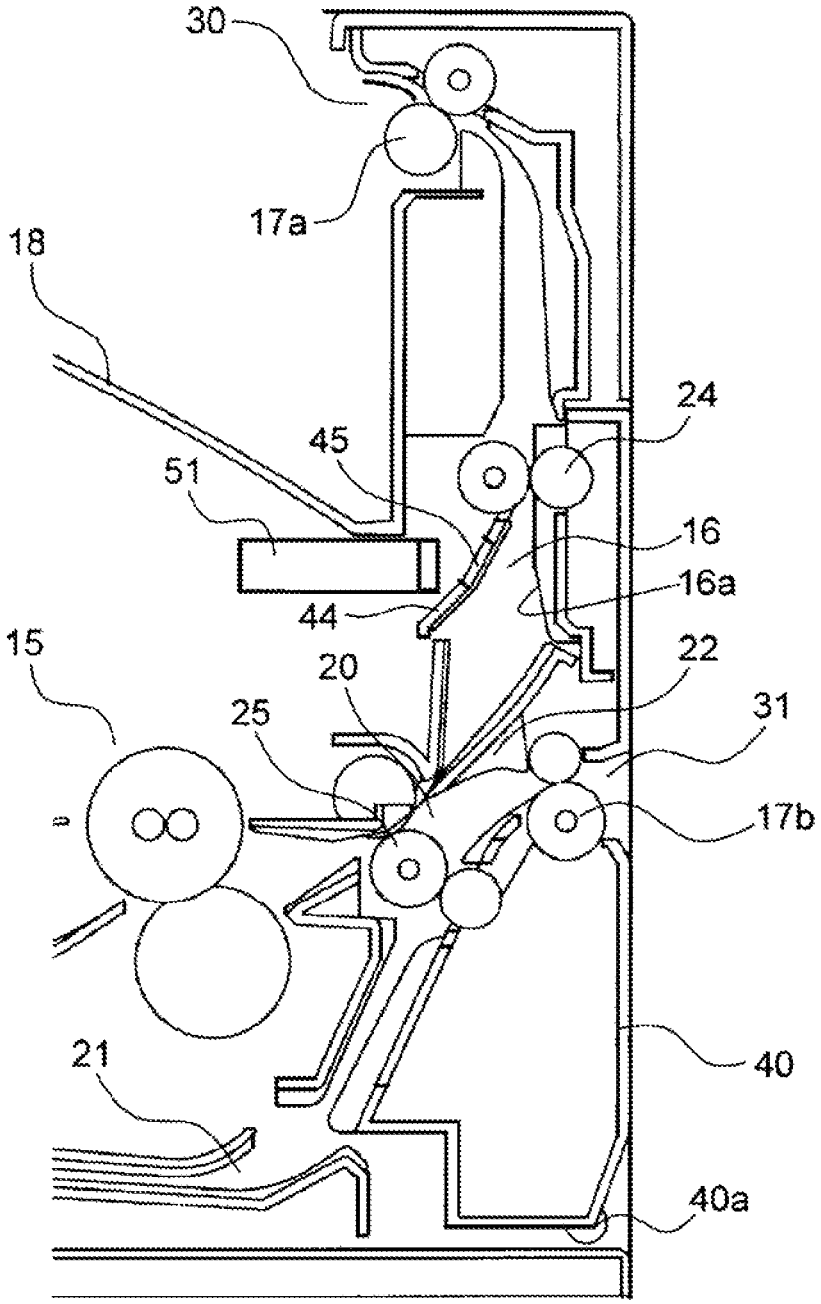
FIG. 3 is a partial cross sectional view illustrating a section around a rear cover unit in the image forming apparatus according to an embodiment of the present disclosure.

An image forming apparatus 100 according to an embodiment of the present disclosure will be described below with reference to the accompanying drawings.

The image forming apparatus 100 includes in the interior thereof, an image forming section P and a fixing device 15. The image forming section P forms a monochrome image through processes including charging, exposure, development, and transfer. A photosensitive drum 5 is disposed in the image forming section P. In the image forming section P, a charging unit 4, an exposure unit 7, a developing unit 8, a transfer roller 14, a cleaning device 19, and a static eliminator (not illustrated) are disposed around the photosensitive drum 5 in a rotation direction thereof.

In image formation, the charging unit 4 uniformly charges the photosensitive drum 5 as the photosensitive drum 5 rotates counterclockwise. The exposure unit 7 then irradiates the photosensitive drum 5 with a laser beam based on image data to form an electrostatic latent image on the photosensitive drum 5. The developing unit 8 then attaches toner to the electrostatic latent image to form a toner image.

A toner container 9 supplies toner to the developing unit 8.

Paper (a sheet of paper) is conveyed from a paper feed cassette 10 or a manual paper feeder 113 toward the photosensitive drum 5 on which the toner image is formed via a paper conveyance path 12 and a registration roller pair 13. The transfer roller 14 (an image transfer section) then transfers the toner image formed on the surface of the photosensitive drum 5 to the paper. In this manner, the image forming section P forms the toner image on the paper. The paper to which the toner image is transferred is separated from the photosensitive drum 5 and conveyed to the fixing device 15.

The fixing device 15 is located downstream of the image forming section P in a paper conveyance direction (a sheet conveyance direction). The fixing device 15 applies heat and pressure to the paper to fix the toner image as unfixed yet on the paper.

A diverging guide 22 is disposed at a curved portion 20 of a paper conveyance path (sheet conveyance path) 16. A second paper ejection port 31 in communication with the curved portion 20 is located in a rear surface (a right surface in FIG. 1) of the image forming apparatus 100. The diverging guide 22 determines an ejection destination of the paper to which the toner image is fixed by the fixing device 15 as either a first paper ejection port (a sheet exit port) 30 or the second paper ejection port (a sheet exit port) 31.

Once the paper has passed through the fixing device 15 and a conveyance roller pair 23, the paper is conveyed onto the top of the image forming apparatus 100 through the paper conveyance path 16. In image formation on a single side of the paper (simplex printing), the paper is ejected onto an exit tray 18 from the first paper ejection port 30 via a conveyance roller pair 24 and a first ejection roller pair 17*a*. Alternatively, the paper is ejected from the second paper ejection port 31 via a second ejection roller pair 17*b*. That is, the paper conveyance path 16 guides the paper to the first or second paper ejection port 30 or 31 after the paper has passed through the fixing device 15.

By contrast, in image formation on both sides of the paper (duplex printing), the conveyance roller pair 24 and the first ejection roller pair 17*a* are rotated in the reverse direction to reverse the paper conveyance direction after a tailing edge of the paper passes through the curved portion 20 of the paper conveyance path 16. As a result, the paper is distributed to a reversed paper conveyance path 21 diverging from the curved portion 20 and re-conveyed to the registration roller pair 13 in a state in which a side of the paper that has received the image is reversed. A toner image formed next on the photosensitive drum 5 is transferred by the transfer roller 14 to a side of the paper on which no image is formed. The paper to which the toner images are transferred is conveyed to the fixing device 15, subjected to fixing of the toner images, and then ejected onto the exit tray 18 from the first paper ejection port 30 via the conveyance roller pair 24 and the first ejection roller pair 17*a*. Alternatively, the paper is ejected from the second paper ejection port 31 via the second ejection roller pair 17*b*.

The image forming apparatus 100 includes a rear cover unit 40 (cover unit).

Figure 4:
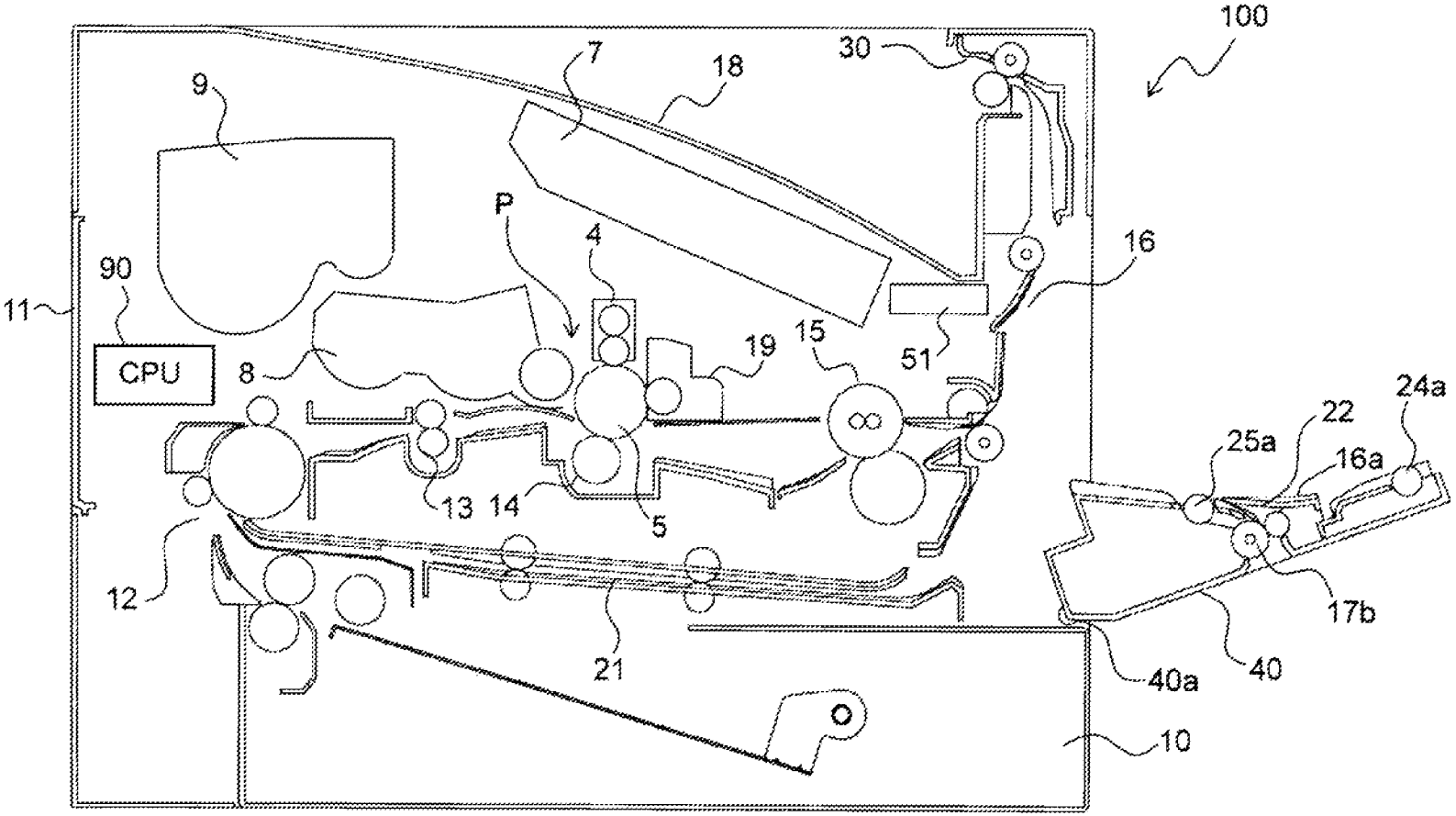
FIG. 4 is a side cross sectional view illustrating a state in which the rear cover unit is open in the image forming apparatus according to an embodiment of the present disclosure.

As illustrated in FIG. 4, the rear cover unit 40 pivots about a pivot fulcrum 40*a* at the lower end part of the rear cover unit 40 and is openable and closable relative to the main body of the image forming apparatus 100. That is, the rear cover unit 40 is supported in an openable and closable manner on the rear surface of the main body of the image forming apparatus 100. The diverging guide 22, one roller 24*a* of the conveyance roller pair 24, one roller 25*a* of a conveyance roller pair 25, and the second ejection roller pair 17*b* are supported on the rear cover unit 40. The rear cover unit 40 constitutes a paper conveyance surface portion (a sheet conveyance surface portion, other one of a pair of sheet conveyance surface portions) at one side (outer side) of the paper conveyance path 16.

Figure 5:
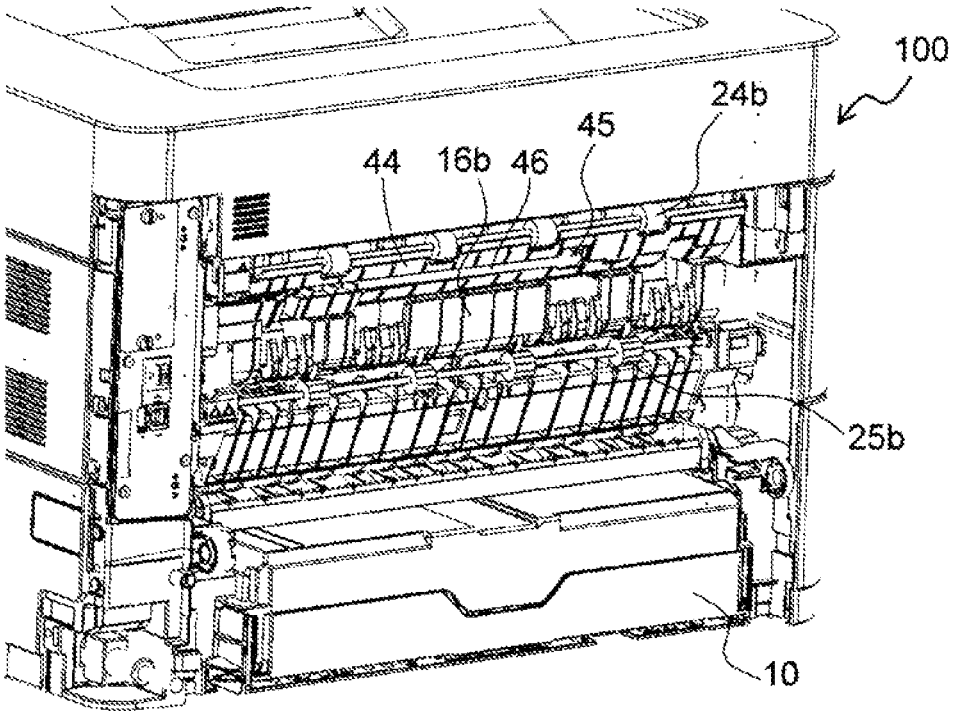
FIG. 5 is an outer perspective view illustrating a state in which the rear cover unit is removed from the image forming apparatus according to an embodiment of the present disclosure.

As illustrated in FIGS. 4 and 5, when the rear cover unit 40 is opened, the paper conveyance path 16 is disassembled. Disassembly of the paper conveyance path 16 can enable removal of a jam (paper jam) in the paper conveyance path 16. Further, a fan (blower) 51 is disposed on the opposite side of the paper conveyance path 16 to the rear cover unit 40.

In addition, a control section 90 is disposed within the image forming apparatus 100 to control operations of various elements including the image forming section P, the fixing device 15, and the fan 51. The control section 90 may include a central processing unit (CPU), for example.

As illustrated in FIG. 5, the other roller 24*b* of the conveyance roller pair 24 and the other roller 25*b* of the conveyance roller pair 25 are supported on another paper conveyance surface portion 16*b* (a sheet conveyance surface portion, the one of the pair of sheet conveyance surface portions) of the paper conveyance path 16.

Figure 6:
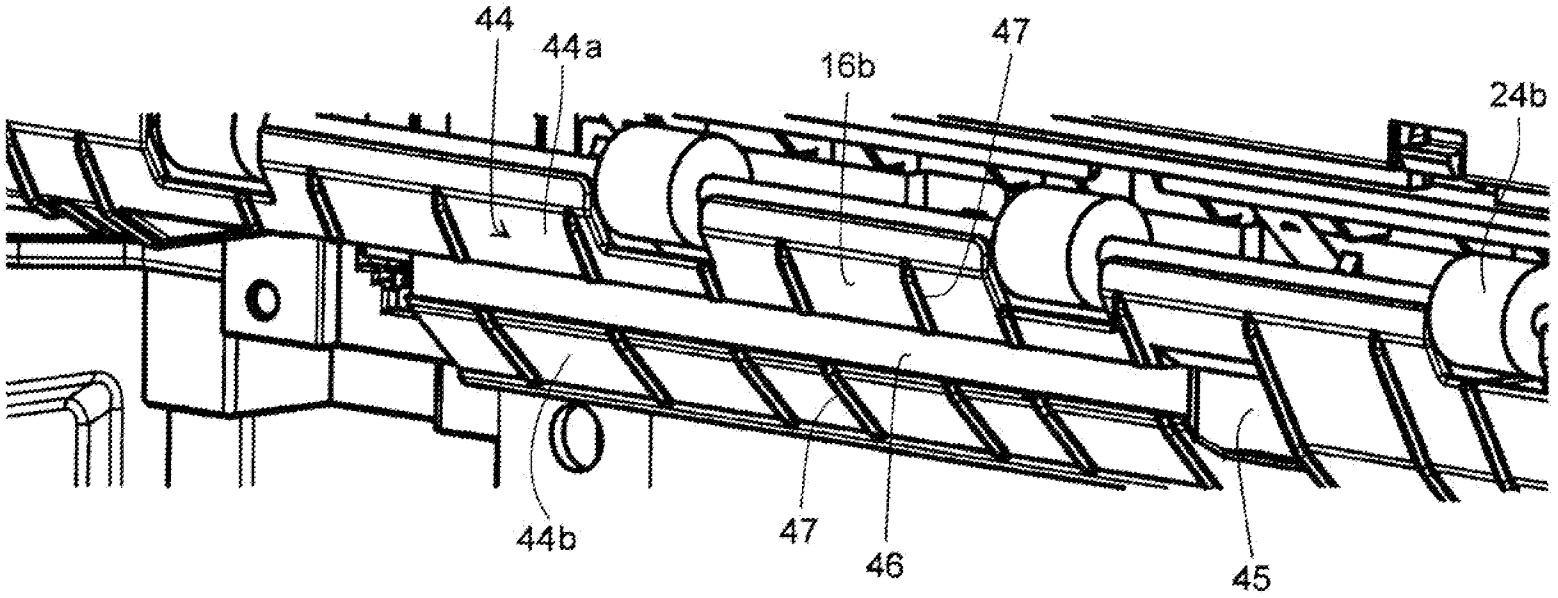
FIG. 6 is a partial cross sectional view illustrating a section around a ventilation port and an air channel in the image forming apparatus according to an embodiment of the present disclosure.

As illustrated in FIGS. 5 and 6, a ventilation port 45, an air channel (an air passage recess) 46, and a plurality of ribs 47 are located in a conveyance guide member 44 that constitutes the paper conveyance surface portion 16*b*.

Each of the ribs 47 extends in the paper conveyance direction and protrudes from the paper conveyance surface portion 16*b* toward the paper conveyance path 16.

The ribs 47 can prevent paper from being caught in the air channel 46.

The ventilation port 45 allows air from the fan 51 to flow into the paper conveyance path 16.

Figure 7:
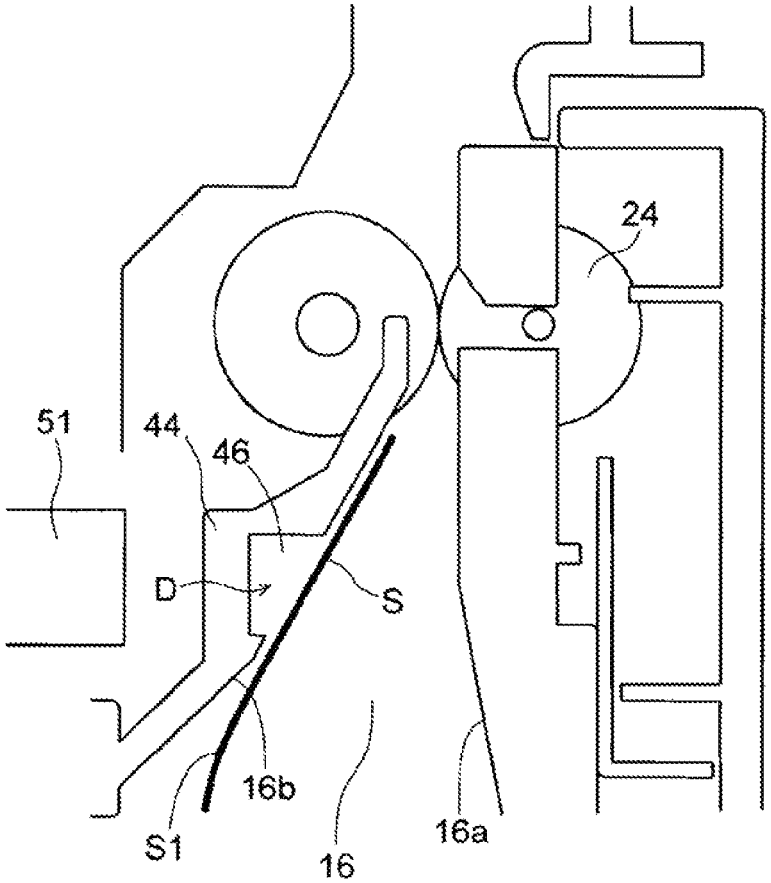
FIG. 7 is a side cross sectional view illustrating a section around the air channel in the image forming apparatus according to an embodiment of the present disclosure.

The air channel 46 is configured to allow the air that has passed through the ventilation port 45 to flow through the air channel 46. Specifically, the conveyance guide member 44 includes a first guide portion 44*a* and a second guide portion 44*b*. The first guide portion 44*a* is disposed adjacently to the second guide portion 44*b* in the paper conveyance direction. The air channel 46 is located between the first and second guide portions 44*a* and 44*b*. The air channel 46 is open toward a central region of the paper conveyance path 16 in the paper width direction, rather than over the entire width of the paper conveyance path 16. Note that the air channel 46 may extend over the entire width of the paper conveyance path 16. The air channel 46 extends in the paper width direction. As illustrated in FIG. 7, the air channel 46 forms a duct D extending in the paper width direction in conjunction with paper S. Note that the ventilation port 45 and the air channel 46 are exposed when the rear cover unit 40 is open.

Figure 8:
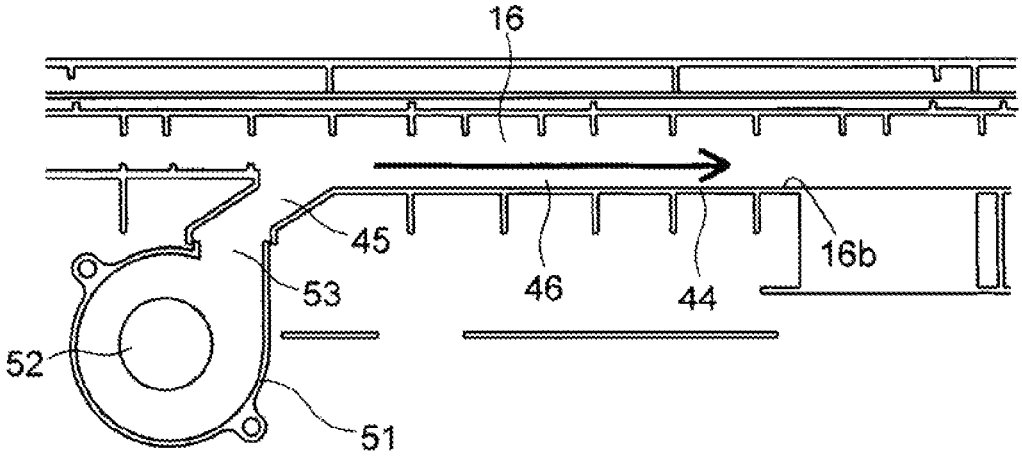
FIG. 8 is a top cross sectional view illustrating a section around the ventilation port in the image forming apparatus according to an embodiment of the present disclosure.

As illustrated in FIG. 8, the fan 51 (see FIG. 1) that blows air into the paper conveyance path 16 through the ventilation port 45 is disposed inward of the paper conveyance surface portion 16*b* (on an opposite side to the paper conveyance path 16). That is, the fan 51 is disposed on the opposite side of the paper conveyance surface portion 16*b* constituted by the conveyance guide member 44 to the paper conveyance path 16 and blows air at the paper passing through the paper conveyance path 16. The air blown from the fan 51 passes through the ventilation port 45, flows into the paper conveyance path 16, and flows through the duct D (see FIG. 7) in the paper width direction.

Figure 9:
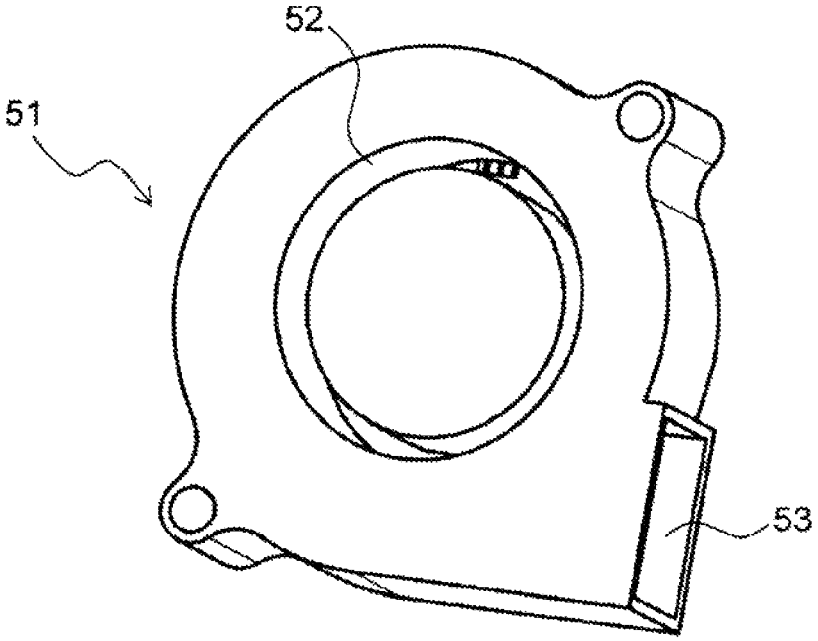
FIG. 9 is a perspective view illustrating a fan disposed in the image forming apparatus according to an embodiment of the present disclosure.

As illustrated in FIG. 9, the fan 51 is a sirocco fan. Specifically, the fan 51 rotates a plurality of blades (not illustrated) extending in the radial direction of the fan 51 to blow from a blowing port 53 located at an outer peripheral part of the fan 51 air sucked from a sucking port 52 at the central part of the fan 51.

Figure 10:
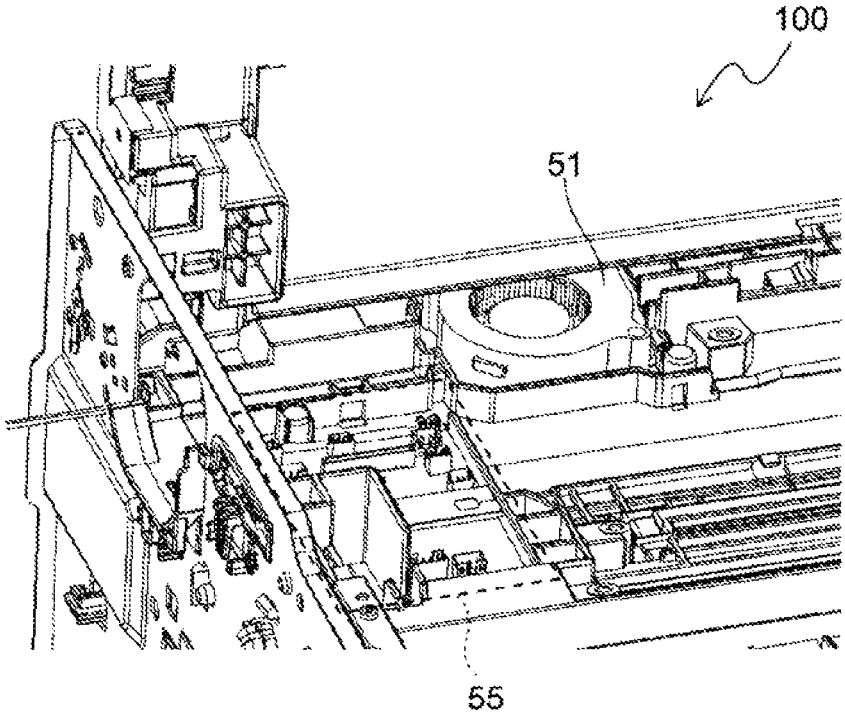
FIG. 10 is a perspective view of a section around the fan in the image forming apparatus as viewed from the front according to an embodiment of the present disclosure.

As illustrated in FIG. 10, a substrate 55 (a portion indicated by a broken line in FIG. 10) on which various electronic components are mounted is disposed in the vicinity of the fan 51. In short, the substrate 55 is disposed adjacently to the fan 51. The fan 51 blows air around the substrate 55 toward the ventilation port 45. Specifically, the fan 51 blows air heated by radiant heat of the substrate 55 toward the ventilation port 45.

As illustrated in FIG. 1, paper S to which a toner image is fixed in the fixing device 15 passes through the curved portion 20 and is conveyed to the paper conveyance path 16 thereabove in the image forming apparatus 100. The paper S is heated when passing through a fixing roller pair of the fixing device 15. In a situation in which the paper S is wet, vapor may be accordingly generated from the heated paper S.

In the present embodiment, the ventilation port 45 allows air from the fan 51 to flow into the paper conveyance path 16. The air channel 46 extends in the paper width direction and allows the air having passed through the ventilation port 45 to pass through the air channel 46. The ventilation port 45 and the air channel 46 are located in the paper conveyance surface portion 16*b* constituted by the conveyance guide member 44. The air from the fan 51 passes through the ventilation port 45, flows into the paper conveyance path 16, and flows through the air channel 46. In this configuration, the air can flow in the width direction of the paper conveyance path 16. Accordingly, sufficient air supply in the width direction of the paper S can be achieved, thereby enabling sufficient dispersion of vapor generated from the paper S in fixing. As a result, condensation and vapor generation can be reduced satisfactorily.

Reduction in condensation can reduce the likelihood of succeeding paper S being dampened by the condensation, thereby reducing generation of wrinkles in the paper P. In duplex printing, a situation in which toner is not transferred to a wet part of paper S and an image void is created can be avoided. Further, steam generation can be prevented and therefore a situation in which a user mistakes steam released outside of the image forming apparatus 100 for smoke can be avoided.

Further, the fan 51 blows air around the substrate 55 toward the ventilation port 45. Heated air around the substrate 55 can be dissipated outside the image forming apparatus 100 through the paper conveyance path 16. As a result, an increase in temperature of the substrate 55 can be suppressed. Comparatively warm air around the substrate 55 is supplied to the paper conveyance path 16. This can prevent vapor generated from paper S from being cooled abruptly. As a result, generation of condensation and steam can be further reduced.

Note that the paper conveyance surface portion 16*b* constituted by the conveyance guide member 44 guides a print side S1 (a first side) of paper S that is subjected to simplex printing or that first receives printing in duplex printing.

Here, in a situation in which the image forming apparatus 100 is used in a low temperature environment, for example, when the fan 51 is operated in a state in which the inside of the image forming apparatus 100 is warmed insufficiently immediately after power-up or return from an energy saving (sleep) mode of the image forming apparatus 100, cool air is blown into the paper conveyance path 16 and at the diverging guide 22, which may induce condensation.

In view of the foregoing, after power-up or return from an energy saving mode of the image forming apparatus, the control section 90 (see FIG. 1) suspends operation of the fan 51 until paper printed is ejected first after the power-up or the return from the energy saving mode of the image forming apparatus 100. In other words, the control section 90 preferably suspends the operation of the fan 51 until paper printed first after power-up or return from the energy saving mode of the image forming apparatus 100 is ejected from the first or second paper ejection port 30 or 31 after the power-up or the return from the energy saving mode of the image forming apparatus 100. Accordingly, a situation in which the fan 51 is operated in a state in which the inside of the image forming apparatus 100 is not sufficiently heated can be avoided. As a result, condensation due to cool air being blown into the paper conveyance path 16 and at the diverging guide 22 can be prevented. Note that although the fan 51 does not blow air at paper to be first subjected to printing, the amount of vapor released from a single sheet of paper is not enough to cause a user to mistake the vapor for smoke.

The embodiment disclosed as above is an example in all aspects and should not be taken to limit the present disclosure. The scope of the present disclosure is defined by the appended claims rather than the above description of the embodiment and encompasses any alterations within the meaning and scope equivalent to the scope of the claims.

For example, a sirocco fan is used as the fan 51 in the above embodiment. However, the fan 51 may be a propeller fan rather than the sirocco fan. The same advantages as in the above embodiment can be obtained in this configuration. The location and the number of fans 51 are not limited as above. Two or more fans 51 may be disposed.

What is claimed is:

1. An image forming apparatus comprising:

an image forming section configured to form a toner image on a sheet;

a fixing device disposed downstream of the image forming section in a sheet conveyance direction and configured to apply heat and pressure to the sheet to fix the toner image as unfixed yet to the sheet;

a sheet conveyance path that has a pair of sheet conveyance surface portions and that guides the sheet to a sheet exit port after the sheet passes through the fixing device;

a conveyance guide member constituting one of the pair of sheet conveyance surface portions;

a blower disposed on an opposite side of the sheet conveyance surface portion constituted by the conveyance guide member to the sheet conveyance path and configured to blow air at the sheet passing through the sheet conveyance path; and a control section configured to control operation of the blower, wherein the sheet conveyance surface portion constituted by the conveyance guide member has:

a ventilation port that allows air from the blower to flow into the sheet conveyance path; and an air passage recess extending in a sheet width direction, the air passage recess allows air that has passed through the ventilation port to flow through the air passage recess, and the control section suspends operation of the blower until a sheet is ejected from the sheet exit port after power-up or return from an energy saving mode of the image forming apparatus, the sheet being printed first after the power-up or the return from the energy saving mode of the image forming apparatus.

2. The image forming apparatus according to claim 1, further comprising a substrate disposed adjacent to the blower, wherein the blower blows air around the substrate toward the ventilation port.

3. The image forming apparatus according to claim 2, wherein the blower blows air heated by radiant heat of the substrate toward the ventilation port.

4. The image forming apparatus according to claim 1, wherein the blower is a sirocco fan having a suction port, a blowing port located in an outer circumferential part of the blower, and a plurality of blades extending in a radial direction of the blower, the blower rotating the blades to blow out from the blowing port air sucked from the suction port.

5. An image forming apparatus comprising:

an image forming section configured to form a toner image on a sheet;

a fixing device disposed downstream of the image forming section in a sheet conveyance direction and configured to apply heat and pressure to the sheet to fix the toner image as unfixed yet to the sheet;

a sheet conveyance path that has a pair of sheet conveyance surface portions and that guides the sheet to a sheet exit port after the sheet passes through the fixing device;

a conveyance guide member constituting one of the pair of sheet conveyance surface portions;

a blower disposed on an opposite side of the sheet conveyance surface portion constituted by the conveyance guide member to the sheet conveyance path and configured to blow air at the sheet passing through the sheet conveyance path; and a control section configured to control operation of the blower, wherein the sheet conveyance surface portion constituted by the conveyance guide member has:

a ventilation port that allows air from the blower to flow into the sheet conveyance path; and an air passage recess extending in a sheet width direction, the air passage recess allows air that has passed through the ventilation port to flow through the air passage recess, the image forming apparatus further comprises a cover unit openable and closable relative to the image forming apparatus, the cover unit constitutes the other one of the pair of sheet conveyance surface portions of the sheet conveyance path, and the ventilation port and the air passage recess are exposed when the cover unit is open.

6. The image forming apparatus according to claim 5, wherein the conveyance guide member includes a first guide portion and a second guide portion, the first guide portion is disposed adjacently to the second guide portion in the sheet conveyance direction, and the air passage recess is located between the first and second guide portions.

7. An image forming apparatus comprising:

an image forming section configured to form a toner image on a sheet;

a fixing device disposed downstream of the image forming section in a sheet conveyance direction and configured to apply heat and pressure to the sheet to fix the toner image as unfixed yet to the sheet;

a sheet conveyance path that has a pair of sheet conveyance surface portions and that guides the sheet to a sheet exit port after the sheet passes through the fixing device;

a conveyance guide member constituting one of the pair of sheet conveyance surface portions;

a blower disposed on an opposite side of the sheet conveyance surface portion constituted by the conveyance guide member to the sheet conveyance path and configured to blow air at the sheet passing through the sheet conveyance path; and a control section configured to control operation of the blower, wherein the sheet conveyance surface portion constituted by the conveyance guide member has:

a ventilation port that allows air from the blower to flow into the sheet conveyance path; and an air passage recess extending in a sheet width direction, the air passage recess allows air that has passed through the ventilation port to flow through the air passage recess, the conveyance guide member includes a rib extending in the sheet conveyance direction and protruding from the sheet conveyance surface portion constituted by the conveyance guide member.

8. The image forming apparatus according to claim 7, wherein the air passage recess is open toward a central region of the sheet conveyance path in the sheet width direction.

9. The image forming apparatus according to claim 3, wherein the blower is a sirocco fan having a suction port, a blowing port located in an outer circumferential part of the blower, and a plurality of blades extending in a radial direction of the blower, the blower rotating the blades to blow out from the blowing port air sucked from the suction port.

10. The image forming apparatus according to claim 9 further comprising a cover unit openable and closable relative to the image forming apparatus, wherein the cover unit constitutes the other one of the pair of sheet conveyance surface portions of the sheet conveyance path, and the ventilation port and the air passage recess are exposed when the cover unit is open.

11. The image forming apparatus according to claim 10, wherein the conveyance guide member includes a first guide portion and a second guide portion, the first guide portion is disposed adjacently to the second guide portion in the sheet conveyance direction, and the air passage recess is located between the first and second guide portions.

12. The image forming apparatus according to claim 11, wherein the conveyance guide member includes a rib extending in the sheet conveyance direction and protruding from the sheet conveyance surface portion constituted by the conveyance guide member.

13. The image forming apparatus according to claim 12, wherein the air passage recess is open toward a central region of the sheet conveyance path in the sheet width direction.

14. The image forming apparatus according to claim 9, wherein the conveyance guide member includes a rib extending in the sheet conveyance direction and protruding from the sheet conveyance surface portion constituted by the conveyance guide member.

15. The image forming apparatus according to claim 9, wherein the air passage recess is open toward a central region of the sheet conveyance path in the sheet width direction.

* * * * *